US007171835B2

(12) United States Patent
Nakazato

(10) Patent No.: US 7,171,835 B2
(45) Date of Patent: Feb. 6, 2007

(54) BENDING APPARATUS

(75) Inventor: Kazuhiko Nakazato, Koga (JP)

(73) Assignee: Sanoh Industrial Co., Ltd., Koga (JP)

( * ) Notice: Subject to any disclaimer, the term of this patent is extended or adjusted under 35 U.S.C. 154(b) by 0 days.

(21) Appl. No.: 11/212,881

(22) Filed: Aug. 29, 2005

(65) Prior Publication Data

US 2006/0053854 A1 Mar. 16, 2006

(30) Foreign Application Priority Data

Sep. 10, 2004 (JP) ..... 2004-263965

(51) Int. Cl.
*B21D 9/05* (2006.01)

(52) U.S. Cl. ..... 72/150; 72/369; 72/466.2

(58) Field of Classification Search ..... 72/466.2, 72/369, 150
See application file for complete search history.

(56) References Cited

U.S. PATENT DOCUMENTS 1,099,669 A * 6/1914 Ruckstinat ..... 72/150
1,598,893 A * 9/1926 Taylor ..... 72/369
2,305,951 A * 12/1942 Carl ..... 72/112
4,009,601 A * 3/1977 Shimizu ..... 72/369
4,481,803 A * 11/1984 Dieser ..... 72/150
2004/0011106 A1* 1/2004 Hatano ..... 72/150
2005/0268684 A1* 12/2005 Nakazato ..... 72/335

FOREIGN PATENT DOCUMENTS

JP 05149157 A * 6/1993

* cited by examiner

*Primary Examiner*—Lowell A. Larson
*Assistant Examiner*—Teresa M. Bonk
(74) *Attorney, Agent, or Firm*—Posz Law Group, PLC; R. Eugene Varndell, Jr.

(57) ABSTRACT

A bending apparatus which can bend pipes and obtain as small curvature as possible without flattening or buckling easily occurring in the bending region. The bending apparatus comprises a bending die for a pipe, a clamping die which rotates together with the bending die while clamping the pipe, a pressure die which hold down the pipe, and a metal core which is inserted into the pipe and maintains the shape of the bending region, wherein the metal core is a spherical metal core rotatably supported by an arch shaped arm on the leading end of a core holder.

6 Claims, 6 Drawing Sheets

(a)

(b)

BENDING APPARATUS

BACKGROUND OF THE INVENTION

1. Field of the Invention

The present invention relates to a bending apparatus, and more particularly to a bending apparatus suitable for bending pipes with a small bending radius.

2. Description of the Related Art

The use of smaller components in automobile engine compartments and cooling apparatus have increased in recent years, and demand is increasing for metal pipes which are bent to a small bending radius, for instance to a bending radius which is smaller than the diameter of the pipe, in order to connect between components which are tightly arranged.

As shown in FIG. 5 and FIG. 6, a conventional bending apparatus bends pipe 50 to a prescribed angle by interposing the pipe 50 between a bending die 51 and a clamping die 52, holding down the pipe 50 using a pressure die 53, and in this condition, rotating the bending die 51 and the clamping die 52 with the center O of the bend as the center of rotation.

However, when a bend with a tight bending radius is attempted with the aforementioned conventional bending apparatus, the outside wall 54*a* in the bending region 54 formed in the pipe 50 will be elongated, and there will be problems with flattening of the pipe and the wall thickness becoming extremely thin as shown in FIG. 6. In order to resolve these problems, a method to apply pressure in the direction of the bending region 54 of the pipe 50 while bending has been proposed, but in this case, buckling will occur in the pipe on the inside wall 54*b* of the bending region 54, so the appearance will be poor and the cross-section area of the pipe 50 will be significantly reduced in the bending region 54.

Therefore, as shown in FIG. 7, various types of correction cores 55 or the like are used after bending to correct the flattening or buckling, and in Japanese Patent Application Laid Open No. H6-262282, technology is disclosed which simultaneously processes the ends with a spool or a bulge or the like using an operation to correct the flattening or buckling of the pipe after the bending has been performed.

However, the aforementioned post-bending pipe correcting operation is an inconvenient operation, requires fabrication of a correction core 55 or the like, and increases the number of correction processes using the correction core 55, so the manufacturing costs of bent pipe will increase, and although the correcting process is performed at the same time as processing the ends with a spool or bulge as shown in Japanese Patent Application Laid Open No. H6-262282, preferably the operation would eliminated if possible.

SUMMARY OF THE INVENTION

With the foregoing in view, an object of the present invention is to provide a bending apparatus which can bend pipes and obtain as small curvature as possible without easily buckling or flattening in the bending region.

In order to achieve the above object, the present invention comprises a pipe bending die, a clamping die which rotates together with a bending die while clamping the pipe, a pressure die which holds down the pipe, and a metal core which is inserted into the pipe and maintains the shape of the bending region, wherein the metal core is a spherical metal core rotatably supported on the end of a core holder.

With the bending apparatus of the present invention, the spherical core which is inserted into the pipe always contacts the inside wall in the bending region where buckling readily occurs during the bending process and prevents buckling or the like from occurring on the inside wall of the bending region, and therefore the shape can be stable when bending with a tight bend radius.

Furthermore, the present invention is the aforementioned invention wherein the spherical metal core is rotatably supported on the end of a core holder through an arch shaped arm.

Using this bending apparatus of the present invention, the spherical core is supported on the core holder by means of an arch shaped arm, so contact between the inside wall surface of the bending region and the arm can be avoided because of the arched region, and therefore, large bends are possible and the spherical metal core can be inserted deeper into the bending region.

Furthermore, the present invention is the aforementioned invention for a bending apparatus comprising a mechanism which presses the pressure die and/or the clamping die towards the bending region of the pipe along the axial direction during bending.

Using the pressure die and/or the clamping die for this bending apparatus of the present invention, the material of the pipe is drawn close to the outside wall of the bending region, so thinning of the material thickness of the outside wall of the bending region can be prevented and the bending process will not readily cause cracks and flattening.

Furthermore, the present invention is the aforementioned invention wherein a wrinkle removing die is provided in the position opposite the pressure die.

Using this bending apparatus of the present invention, the wrinkle removing die restrains the region around the inside wall of the bending region of the pipe so that wrinkles on the outside of the pipe can be prevented and a higher-quality bend can be performed.

DESCRIPTION OF THE PREFERRED EMBODIMENTS

Figure 1:
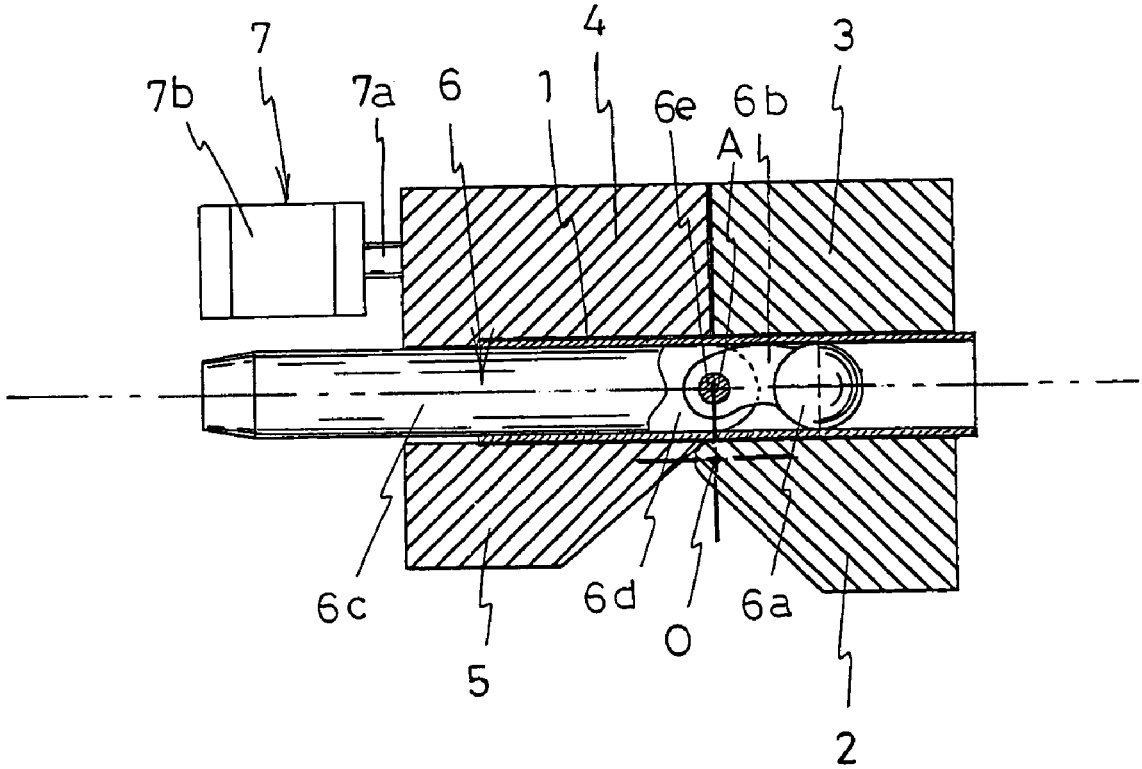
FIG. 1 is a cross-section drawing schematically showing an embodiment of the bending apparatus of the present invention.

A preferred embodiment of the bending apparatus of the present invention will be described in detail below while referring to the drawings.

As shown in FIG. 1, the bending apparatus of the present invention has a pipe 1 bending die 2, a clamping die 3 which sandwiches the pipe 1 together with bending die 2 and rotates together with the bending die 2, and a pressure die 4 which presses the pipe 1, and furthermore, in this preferred embodiment, a pipe 1 wrinkle removing die 5 is established at a position opposite to the pressure die 4.

Note, although omitted from the drawings, the surfaces of the bending die 2 and the clamping die 3 have semicircular grooves which match the shape of the pipe 1, and the surfaces of the pressure die 4 and the wrinkle removing die 5 also have similar grooves.

Figure 2:
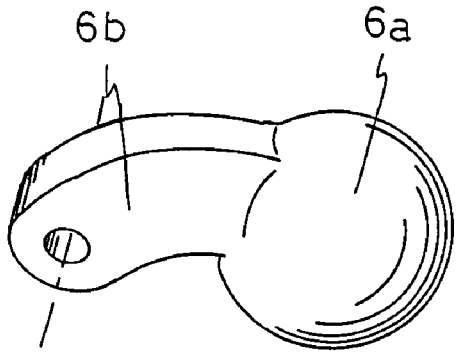
FIG. 2 is a diagram showing an embodiment of the metal core which is used in the bending apparatus of the present invention, (a) being a perspective view showing the main components of the metal core, and (b) being a perspective view showing the whole metal core.
Figure 2:
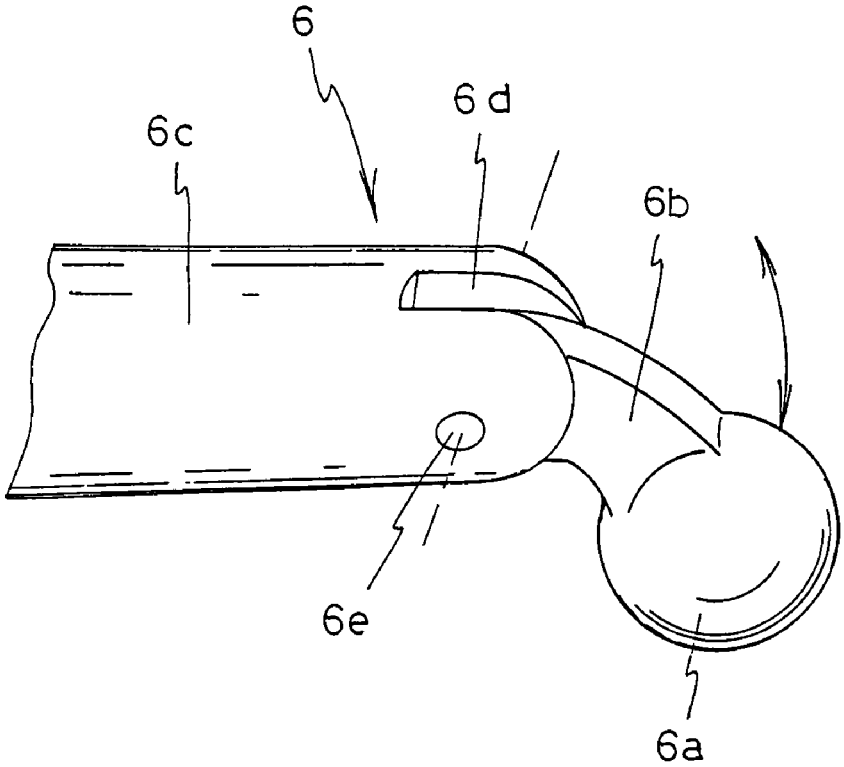

Furthermore, a metal core 6 which maintains the shape of the bending region of the pipe 1 is inserted into place from one end of the pipe 1. As described in FIG. 2, this metal core 6 has a spherical metal core 6*a* which is formed as a sphere or elliptical sphere with a diameter that has nearly the same dimensions as the inside diameter of the pipe 1, and an arch shaped arm 6*b* protrudes from the spherical metal core 6*a*. One end of this arch shaped arm 6*b* is inserted into a split 6*d* which is formed on the leading end of the metal core holder 6*c* and is rotatably supported on the leading end of the metal core holder 6*c* by a pin 6*e*.

Figure 4:
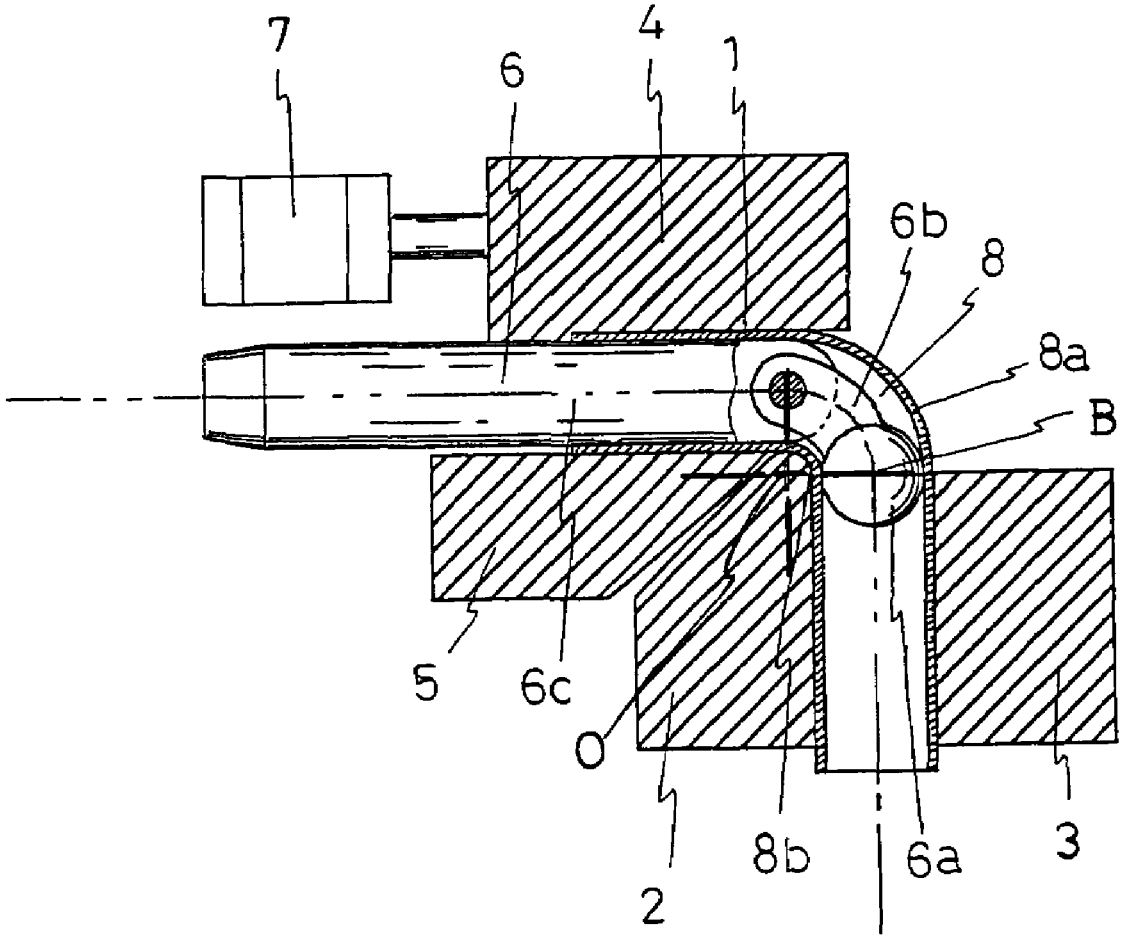
FIG. 4 is a cross section diagram schematically showing the pipe bending process using the bending apparatus shown in FIG. 1.
Figure 5:
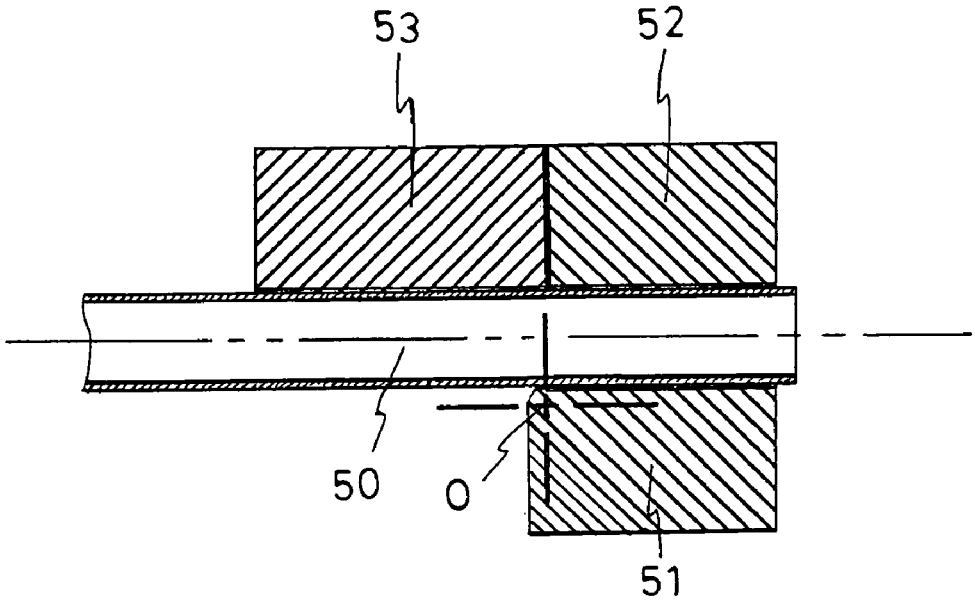
FIG. 5 is a cross section diagram schematically showing a conventional pipe bending apparatus.
Figure 6:
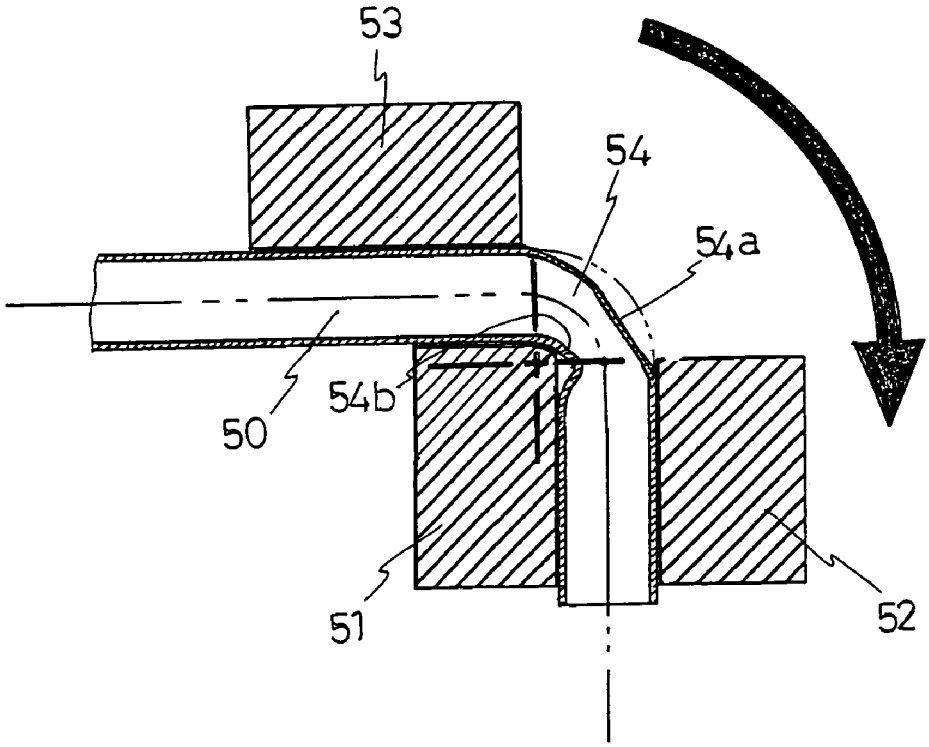
FIG. 6 is a cross section diagram schematically showing the pipe bending process using the bending apparatus shown in FIG. 5.
Figure 7:
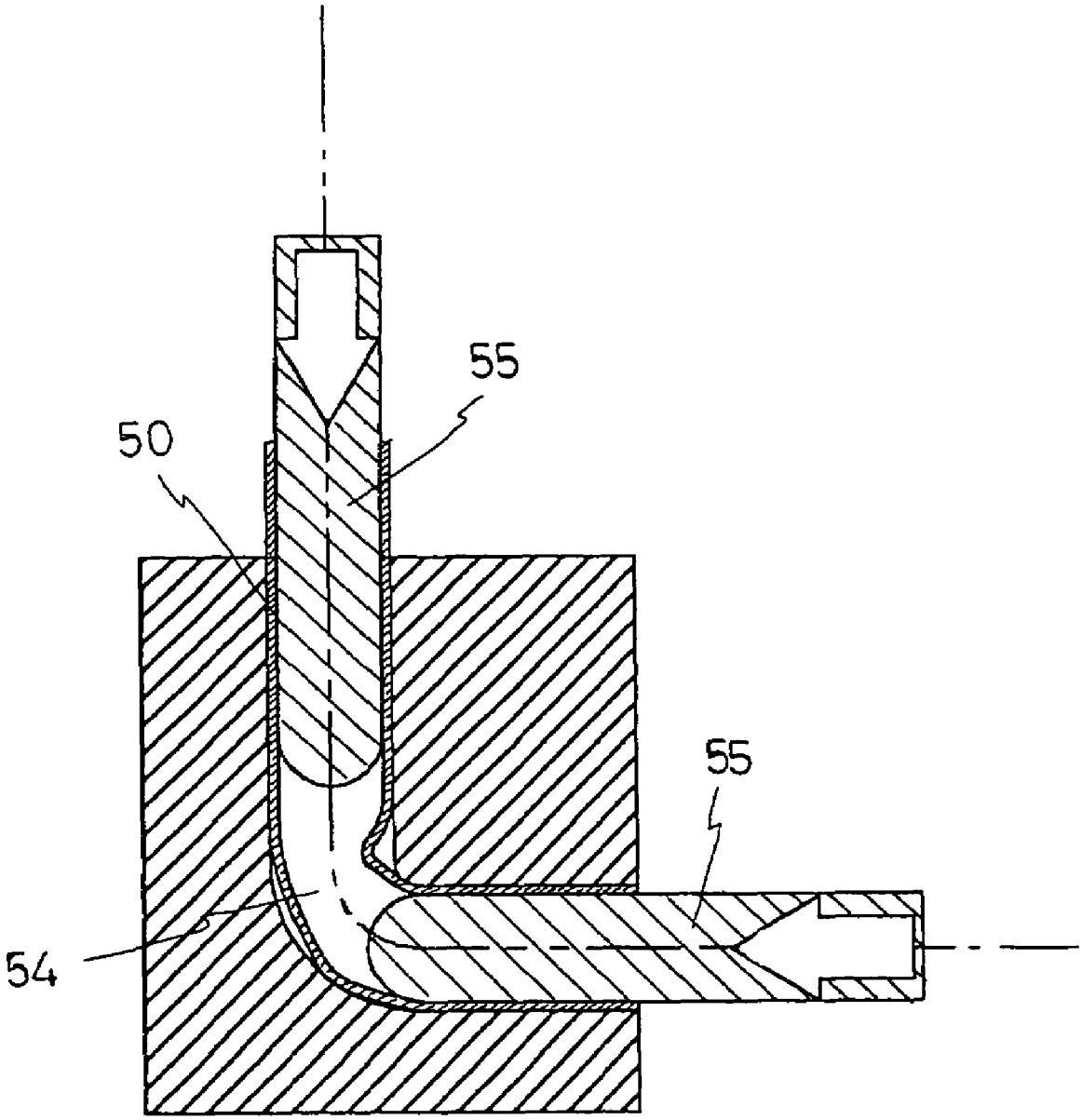
FIG. 7 is a cross section diagram schematically showing a pipe correcting operation.

As described in FIG. 1, the dimensional shape of the arch shaped arm 6*b* is designed such that before the bending process, when the aforementioned metal core 6 is inserted in the pipe to a position where the center of rotation A of the arch shaped arm 6*b* in the pipe 1 is aligned to the center of bending O of the bending die 2, and when the bending is completed, the center B of the spherical metal core 6*a* is aligned with the center of bending O of the bending die 2, as shown in FIG. 4.

Furthermore, the bending apparatus of the present invention comprises a mechanism 7 which presses the pressure die 4 in the direction of the bending region of the pipe 1 along the axial direction during bending. This pressing mechanism 7 is constructed such that a piston rod 7*a* is connected to the pressure die 4 by a cylinder 7*b*, and is constructed to apply a force on the pressing die 4 to either a prescribed force or a prescribed displacement.

Figure 3:
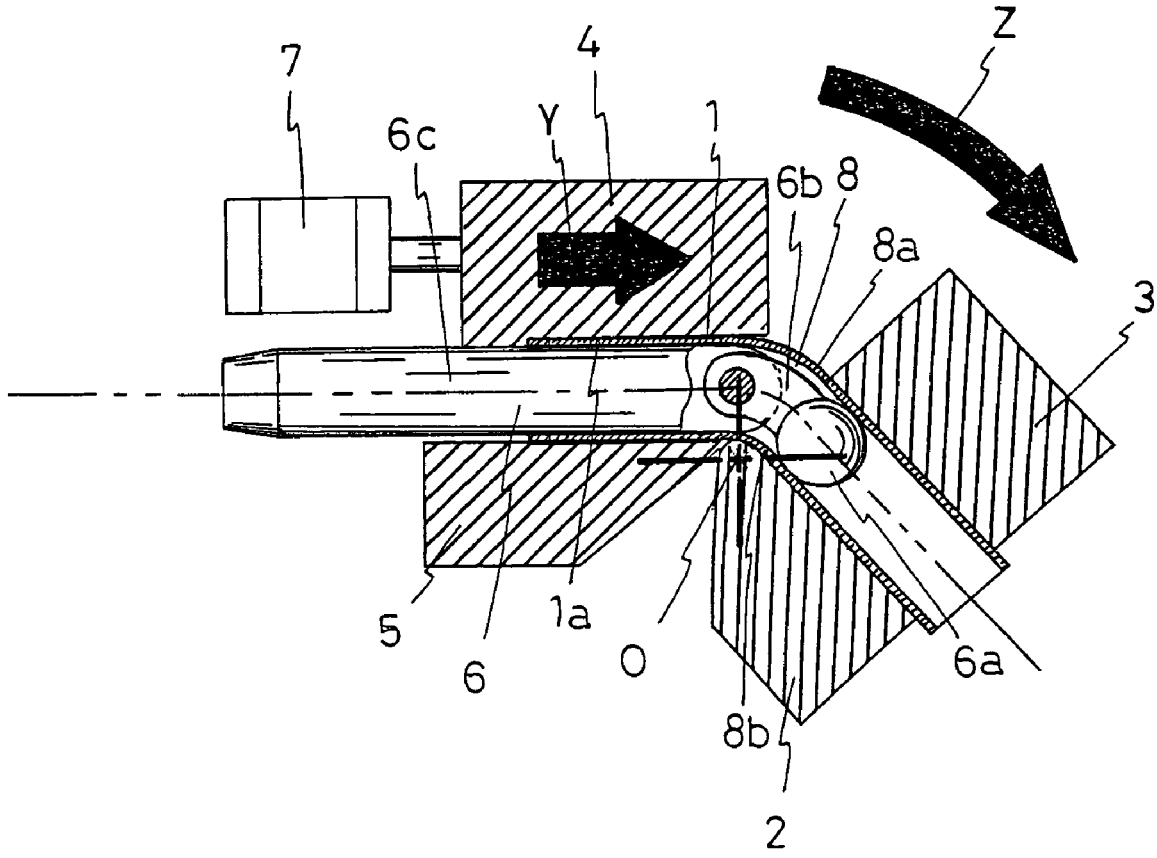
FIG. 3 is a cross section diagram schematically showing the pipe bending process using the bending apparatus shown in FIG. 1.

As shown in FIG. 3, with the bending apparatus of the present invention having the aforementioned construction, the bending die 2 and the clamping die 3 are rotated in the direction of arrow Z with the center of bending O at the center while the pressure die 4 is pressed and slides in the direction of the bending region Y along the axial direction of the pipe by the pressing mechanism 7, thus gradually bending the pipe 1. Furthermore, as shown in FIG. 4, a pipe 1 is formed with substantially a 90° bend which has a small curvature radius in the bending region 8 of the pipe 1, and for example, the curvature radius may be approximately 0.7 times the diameter of the pipe 1.

During the bending process, when the pipe 1 is bent by the bending die 2 and the clamping die 3, the inside wall 8*b* in the bending region 8 will deform in an attempt to buckle, but as shown in FIG. 3 and FIG. 4, the spherical metal core 6*a* of the metal core 6 which is inserted into the pipe 1 will always be in contact with the inside wall 8*b* of the bending region 8 where buckling readily occurs, so buckling or the like of the inside wall 8*b* of the bending region 8 can be prevented.

In other words, the spherical metal core 6*a* is rotatably supported on the core holder 6*c* by the arch shaped arm 6*b*, so contact between the arm 6*b* and the inside wall surface 8*b* of the bending region 8 of the pipe can be avoided because of the arch shape, and in addition to allowing a large bend in the pipe 1, the spherical metal core 6*a* can be inserted deeper into the bending region 8 of the pipe 1, and because the spherical metal core 6*a* is inserted deeper into the bending region 8, buckling of the inside wall 8*b* of the bending region 8 of the pipe 1 can positively be suppressed.

Furthermore, one side of the wall 1*a* of the pipe 1 which contacts with the pressure die 4 which is on the outer wall 8*a* side of the bending region 8 of the pipe 1 is pressed in the axial direction in the direction Y toward the bending region by the pressure die 4, or in other words, the material of the pipe 1 is drawn in toward the outer wall 8*a* region of the bending region 8 by the pressure die 4, so even when stretched by the bending of the pipe 1, the material thickness of the outer wall 8*a* of the bending region 8 will not be made thin, and the bending can be performed without cracking or flattening readily occurring.

Furthermore, during bending, the wrinkle removing die 5 restrains the region around the inside wall of the bending region 8 of the pipe 1, so wrinkling or the like of the outside of the pipe 1 can be prevented, and thereby the quality of the pipe can be further improved.

A preferred embodiment of the bending apparatus of the present invention has been described above, but the present invention is not restricted in any way by this embodiment and various modifications and alterations are possible within the technically conceivable scope of the present invention shown in the patent claims.

For instance, in the above embodiment, the spherical metal core 6*a* was shown in the drawings as a near spherical body, but elliptical spheres like a football, spherical bodies made by connecting curved surfaces of varying curvatures, or spherical bodies which have a partial flat surface, or the like are also acceptable.

Furthermore, in the above embodiment, the pressure die 4 was described as having a mechanism 7 for pushing the die in the direction of the bending region of the pipe along the axial direction, but it is also acceptable for the clamping die 3 to have a mechanism for pushing the pipe in the direction of the bending region along the axial direction. Furthermore, it is preferable if both the pressure die 4 and the clamping die 3 have a mechanism for pushing the dies in the direction of the bending region of the pipe along the axial direction, because the material of the pipe can be better drawn to the outside wall region of the bending region.

Furthermore, in the above embodiment, a wrinkle removing die 5 was described as being established in the position opposite to the pressure die 4, but the wrinkle removing die 5 is not absolutely necessary. However, using the wrinkle removing die is preferable if many wrinkles occur in the region proximal to the inside of the bending region of the pipe.

Furthermore, in the above embodiment, the pipe 1 was described as being bent to an approximately 90° angle by rotating the bending die 2 and a clamping die 3 with the center of bending O at the center, but even larger bends, such as bends of approximately 100° are possible by changing the shape of the bending die and the wrinkle removing die.

What is claimed is:

1. A bending apparatus comprising a pipe bending die, a clamping die which rotates together with the pipe bending die while clamping a pipe, a pressure die which holds down the pipe, and a metal core which is inserted into the pipe and maintains the shape of the bending region, wherein;

the metal core is a spherical metal core rotatably supported on the end of a core holder by an arch shaped arm, and a dimensional shape of the arch shaped arm is designed such that before the bending process, when the metal core is inserted in a pipe to a position where a center of rotation of the arch shaped arm in the pipe is aligned to a center of bending of the pipe bending die, and when the bending is completed, a center of the spherical metal core is aligned with the center of bending of the pipe bending die.

2. The bending apparatus according to claim 1, wherein the spherical metal core and the arch shaped arm are integrally formed of a metal.

3. The bending apparatus according to claim 1, comprising a mechanism which presses the pressure die and/or the clamping die towards the bending region of the pipe along the axial direction during bending.

4. The bending apparatus according to claim 1, wherein a wrinkle removing die is provided in the position opposite the pressure die.

5. A bending apparatus comprising:

a pipe bending die having a center of bending around which a pipe is bent;

a clamping die that rotates together with the pipe bending die while clamping the pipe;

a pressure die that holds down the pipe; and a metal core that is rotatably supported on an end of a core holder and that is inserted into the pipe and maintains the shape of the bending region, wherein the metal core is a spherical metal core rotatably supported on the end of the core holder by an arch shaped arm; the arch shaped arm being arranged together with the pipe where, before a bending process, a center of rotation of the arch shaped arm in the pipe is aligned to the center of bending of the pipe bending die, and after the bending process, a center of the spherical metal core is aligned with the center of bending of the pipe bending die.

6. The bending apparatus according to claim 5, wherein the metal core is a spherical metal core.

* * * * *